US008144112B2

(12) United States Patent
Huang

(10) Patent No.: US 8,144,112 B2
(45) Date of Patent: Mar. 27, 2012

(54) BACKLIGHT MODULATION CIRCUIT HAVING ROUGH AND FINE ILLUMINATION SIGNAL PROCESSING CIRCUIT

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 754 days.

(21) Appl. No.: 12/287,670

(22) Filed: Oct. 10, 2008

(65) Prior Publication Data

US 2009/0096742 A1 Apr. 16, 2009

(30) Foreign Application Priority Data

Oct. 10, 2007 (CN) ..... 2007 1 0123810

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 5,844,540 | A | 12/1998 | Terasaki | |
| 2005/0057484 | A1 * | 3/2005 | Diefenbaugh et al. | 345/102 |
| 2007/0001998 | A1 * | 1/2007 | Smith et al. | 345/102 |
| 2007/0222739 | A1 * | 9/2007 | Yu et al. | 345/102 |
| 2008/0204395 | A1 * | 8/2008 | Kang et al. | 345/102 |
| 2008/0211762 | A1 * | 9/2008 | Kim et al. | 345/102 |
| 2008/0315796 | A1 * | 12/2008 | Huang | 315/307 |
| 2009/0015544 | A1 * | 1/2009 | Huang | 345/102 |

FOREIGN PATENT DOCUMENTS

CN 1384415 A 12/2002

* cited by examiner

*Primary Examiner* — Chanh Nguyen
*Assistant Examiner* — Roy Rabindranath
(74) *Attorney, Agent, or Firm* — Altis Law Group, Inc.

(57) ABSTRACT

An exemplary backlight modulation circuit includes a backlight source, a backlight driving circuit, a rough modulation key, a fine modulation key, a scaler, and an illumination modulation signal processing circuit. The backlight driving circuit is configured for driving the backlight source. The rough modulation key and the fine modulation key are configured for generating a rough triggering signal and a fine triggering signal. The scaler is configured for receiving the rough triggering signal and the fine triggering signal, and generating an illumination modulation signal. The illumination modulation signal processing circuit is configured for receiving the illumination modulation signal, and processing the illumination modulation signal to generate one of a rough modulation controlling signal to modulate illumination of the backlight source in a large range and a fine modulation controlling signal to modulate the illumination of the backlight source in a small range.

9 Claims, 3 Drawing Sheets

BACKLIGHT MODULATION CIRCUIT HAVING ROUGH AND FINE ILLUMINATION SIGNAL PROCESSING CIRCUIT

FIELD OF THE INVENTION

Embodiments of the present disclosure relate to systems of backlight modulation circuits that are typically used in liquid crystal displays (LCDs), and more particularly to a backlight modulation circuit with rough and fine modulation functions.

GENERAL BACKGROUND

Because LCDs have the advantages of portability, low power consumption, and low radiation, they have been widely used in various portable information products such as notebooks, personal digital assistants (PDAs), video cameras, etc.

A conventional LCD typically includes a liquid crystal (LC) panel, a backlight module with a plurality of light sources for illuminating the LC panel, and a backlight modulation circuit for modulating illumination provided by the backlight module.

Referring to FIG. 3, this depicts one embodiment of an analog method for modulating illumination provided by a backlight module of an LCD. In the analog method, as a voltage level for a driving voltage increases, the illumination provided by the backlight module also increases. Likewise, as the voltage level for the driving voltage decreases, the illumination provided by the backlight module also decreases.

In a digital method for modulating illumination provided by a backlight module, pulse width modulation (PWM) and pulse frequency modulation (PFM) may be used. FIG. 4 depicts one embodiment of a PWM method for modulating illumination provided by a backlight module. In the PWM method, a duty ratio of a pulse voltage signal is changed in order to modulate the illumination provided by the backlight module. When the duty ratio increases, the illumination provided by the backlight module also increases. Similarly, when the duty ratio decreases, the illumination provided by the backlight module also decreases.

One drawback of the above-described analog and digital PWM methods is that they can only modulate the illumination provided by the backlight module little by little. However, if an LCD needs to be modulated in both a large range and a precise range, then many modulation commands and signals may need to be analyzed. In such case, modulating the many commands and signals wastes valuable processor cycles and consumes additional energy.

It is desired to provide a backlight modulation circuit which can overcome the above-described deficiencies.

SUMMARY

In one embodiment, a backlight modulation circuit includes a backlight source, a backlight driving circuit, a rough modulation key, a fine modulation key, a scaler, and an illumination modulation signal processing circuit. The backlight driving circuit is configured for driving the backlight source. The rough modulation key and the fine modulation key are configured for generating a rough triggering signal and a fine triggering signal. The scaler is configured for receiving the rough triggering signal and the fine triggering signal, and generating an illumination modulation signal. The illumination modulation signal processing circuit is configured for receiving the illumination modulation signal, and processing the illumination modulation signal to generate one of a rough modulation controlling signal to modulate illumination of the backlight source in a large range and a fine modulation controlling signal to modulate the illumination of the backlight source in a small range.

Other novel features and advantages of the backlight modulation circuit will become more apparent from the following detailed description when taken in conjunction with the accompanying drawings.

DETAILED DESCRIPTION OF CERTAIN INVENTIVE EMBODIMENTS

Reference will now be made to the drawings to describe various inventive embodiments of the present disclosure in detail, wherein like numerals refer to like elements throughout.

Figure 1:
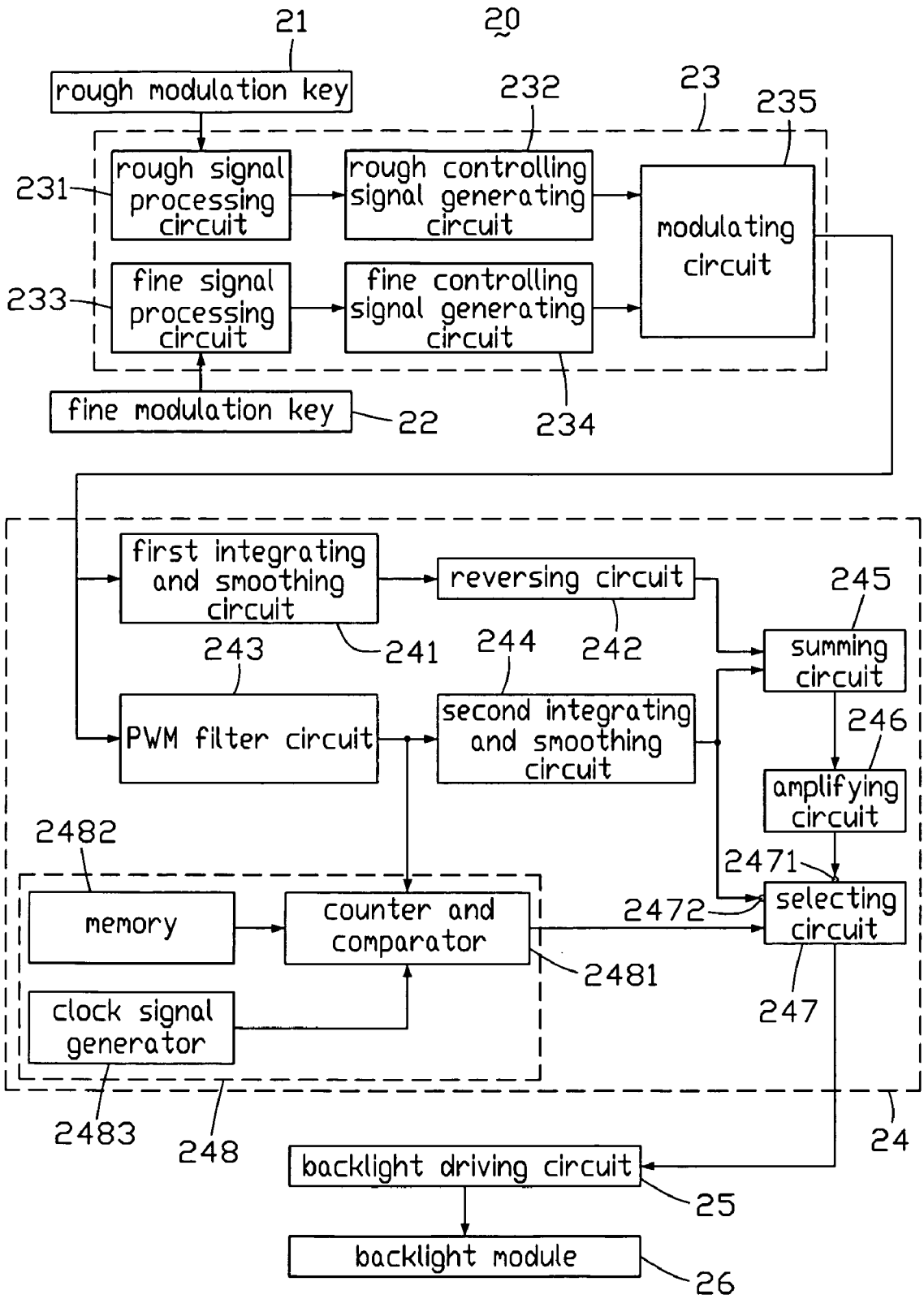
FIG. 1 is a block diagram of a first embodiment of a backlight modulation circuit according to the present disclosure, wherein the backlight modulation circuit may be employed in an LCD.

FIG. 1 is a block diagram of a backlight modulation circuit 20 of a first embodiment of the present disclosure. The backlight modulation circuit 20 may be used in an LCD (not shown) to illuminate the LCD. The backlight modulation circuit 20 includes a rough modulation key 21, a fine modulation key 22, a scaler 23, an illumination modulation signal processing circuit 24, a backlight driving circuit 25, and a backlight module 26. The scaler 23, the illumination modulation signal processing circuit 24, the backlight driving circuit 25, and the backlight module 26 are electrically connected in series. The rough modulation key 21 and the fine modulation key 22 serve as interfaces between the LCD and users. The rough modulation key 21 and the fine modulation key 22 are configured for generating a rough (coarse) triggering signal and a fine triggering signal respectively, and providing these signals to the scaler 23. The scaler 23 generates a rough controlling signal and a fine controlling signal according to the rough triggering signal and the fine triggering signal respectively, and modulates the rough controlling signal and the fine controlling signal into an illumination modulation signal. The scaler 23 outputs the illumination modulation signal to the illumination modulation signal processing circuit 24. The illumination modulation signal processing circuit 24 outputs a rough modulation controlling signal or a fine modulation controlling signal to the backlight driving circuit 25 in response to the illumination modulation signal. The backlight driving circuit 25 drives the backlight module 26 according to the rough modulation controlling signal or the fine modulation controlling signal. Thereby, illumination modulation of the backlight module 26 in both a large range and a smaller precise range is achieved. The backlight module 26 functions as a backlight source, and may for example comprise at least one cold cathode fluorescent lamp (CCFL) or at least one light emitting diode (LED).

The scaler 23 includes a rough signal processing circuit 231, a rough controlling signal generating circuit 232, a fine signal processing circuit 233, a fine controlling signal generating circuit 234, and a modulating circuit 235. The rough signal processing circuit 231 is electrically connected to the rough controlling signal generating circuit 232. The fine signal processing circuit 233 is electrically connected to the fine controlling signal generating circuit 234. The fine controlling signal generating circuit 234 and the rough controlling signal generating circuit 232 are connected to the modulation circuit 235. The modulating circuit 235 includes a controlling variable resistor (not shown). When the rough signal processing circuit 231 receives a rough triggering signal, the rough controlling signal generating circuit 232 generates a rough controlling signal. The rough controlling signal controls the controlling variable resistor of the modulation circuit 235 to generate a desired direct current voltage. When the fine signal processing circuit 233 receives a fine triggering signal, the fine controlling signal generating circuit 234 generates a fine controlling signal. The fine controlling signal may be a PWM signal. A pulse width of the PWM signal increases each time the fine modulation key 22 is triggered. In a typical application, the number of output terminals of the scaler 23 as well as the number of input terminals of the illumination modulation signal processing circuit 24 is limited. Accordingly, the fine controlling signal and the rough controlling signal are combined into the illumination modulation signal.

The illumination modulation signal processing circuit 24 includes a first integrating and smoothing circuit 241, a reversing circuit 242, a PWM filter circuit 243, a second integrating and smoothing circuit 244, a summing circuit 245, an amplifying circuit 246, a selecting circuit 247, and a counting and comparing circuit 248. The first integrating and smoothing circuit 241 and the PWM filter circuit 243 receive the illumination modulation signal from the scaler 23. The illumination modulation signal is integrated and smoothed into a first direct current voltage by the first integrating and smoothing circuit 241, and then is reversed into a negative direct current voltage by the reversing circuit 242. The negative direct current voltage is transmitted to the summing circuit 245. At the same time, the illumination modulation signal is filtered into a PWM signal by the PWM filter circuit 243, and then is integrated into a second direct current voltage by the second integrating and smoothing circuit 244. The second direct current voltage is sent to a second selecting terminal 2472 of the selecting circuit 247 to function as a fine modulation signal. Simultaneously, the second direct current voltage is transmitted to the summing circuit 245. The second direct current voltage and the negative direct current voltage are added by the summing circuit 245, and the summed voltage is amplified by the amplifying circuit 246 to function as a rough modulation signal. The rough modulation signal provided from the amplifying circuit 246 is sent to a first selecting terminal 2471 of the selecting circuit 247.

The counting and comparing circuit 248 includes a counter and comparator 2481, a memory 2482, and a clock signal generator 2483. The memory 2482 stores a pulse width of a predetermined reference PWM signal. The counter and comparator 2481 receives the PWM signal from the PWM filter circuit 243. The clock signal generator 2483 generates clock signals to enable the counter and comparator 2481 to calculate a pulse width of the PWM signal received from the PWM filter circuit 243. The counter and comparator 2481 compares the reference pulse width stored in the memory 2481 with the pulse width of the received PWM signal. When the two compared pulse widths are different, the counter and comparator 2481 outputs a high level voltage to the selecting circuit 247. The pulse width of the received PWM signal is stored in the memory 2482 as the reference PWM signal for a next comparison. In response to the high level voltage, the selecting circuit 247 outputs the fine modulation controlling signal to the backlight driving circuit 25. The backlight driving circuit 25 adjusts illumination of the backlight module 26 in a small and precise range according to the fine modulation controlling signal. When the two compared pulse widths are the same, the counter and comparator 2481 outputs a low level voltage to the selecting circuit 247. In response to the low level voltage, the selecting circuit 247 outputs the rough modulation controlling signal to the backlight driving circuit 25. The backlight driving circuit 25 adjusts illumination of the backlight module 26 in a large and relatively imprecise range according to the rough modulation controlling signal.

The backlight modulation circuit 20 can modulate illumination of the backlight module 26 in both a large and relatively imprecise range and a small and precise range. This provides convenience and reduces operation times.

Figure 2:
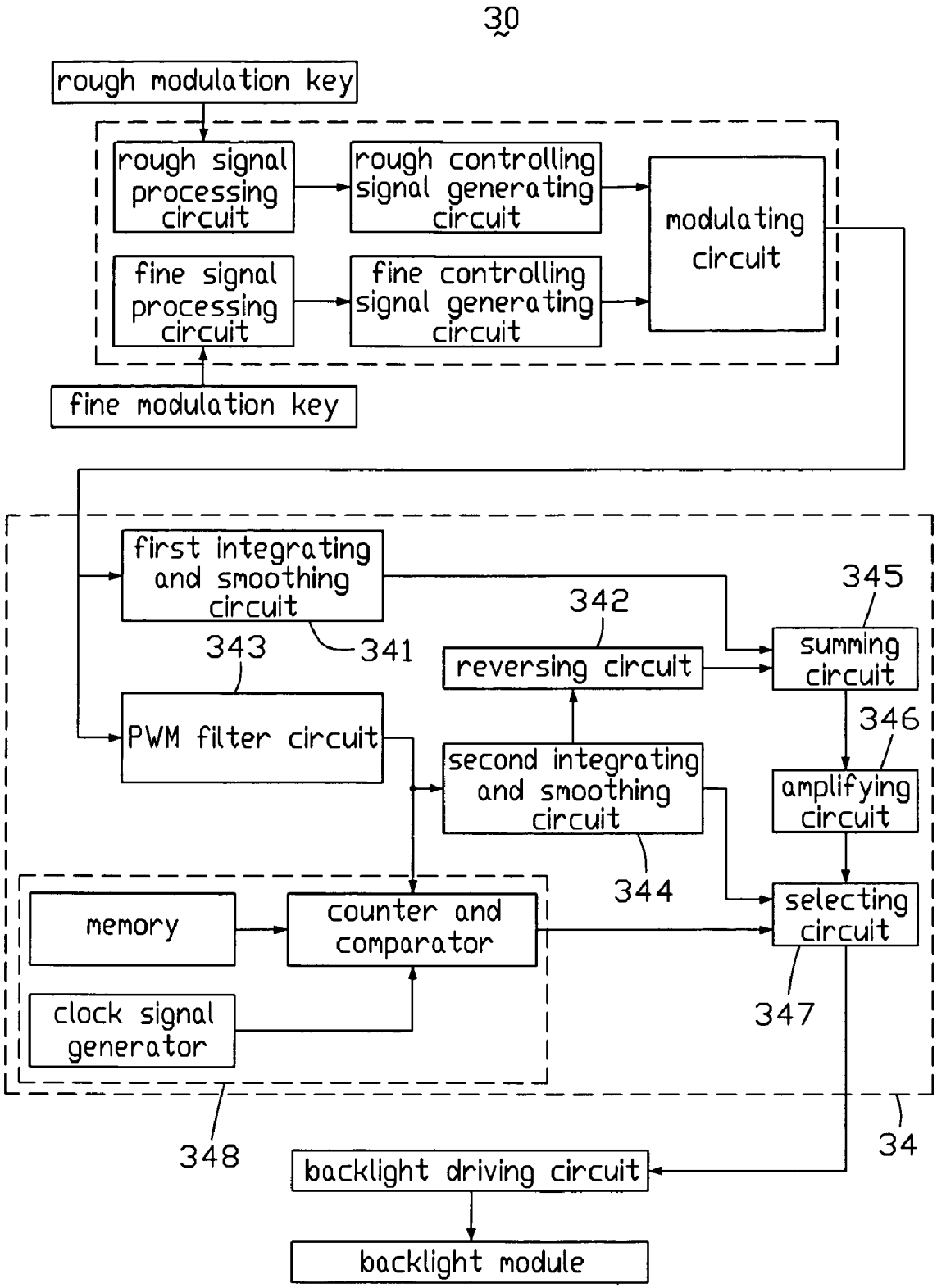
FIG. 2 is a block diagram of a second embodiment of a backlight modulation circuit according to the present disclosure, wherein the backlight modulation circuit may be employed in an LCD.
Figure 3:
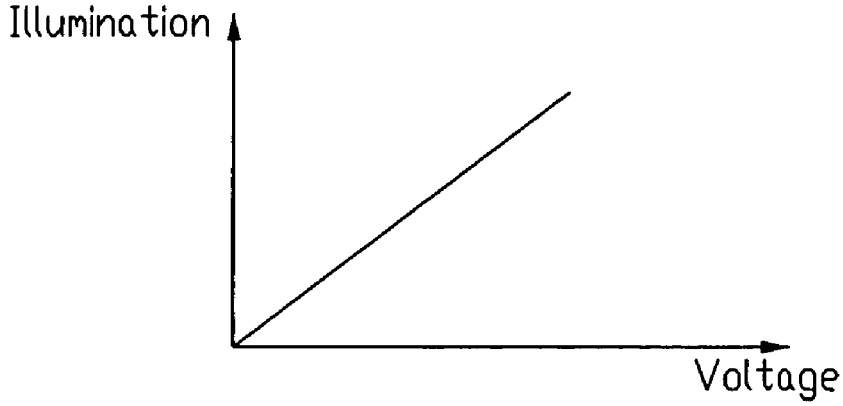
FIG. 3 (RELATED ART)
FIG. 3 depicts one embodiment of a first related art method for modulating illumination of a backlight module of an LCD.
Figure 4:
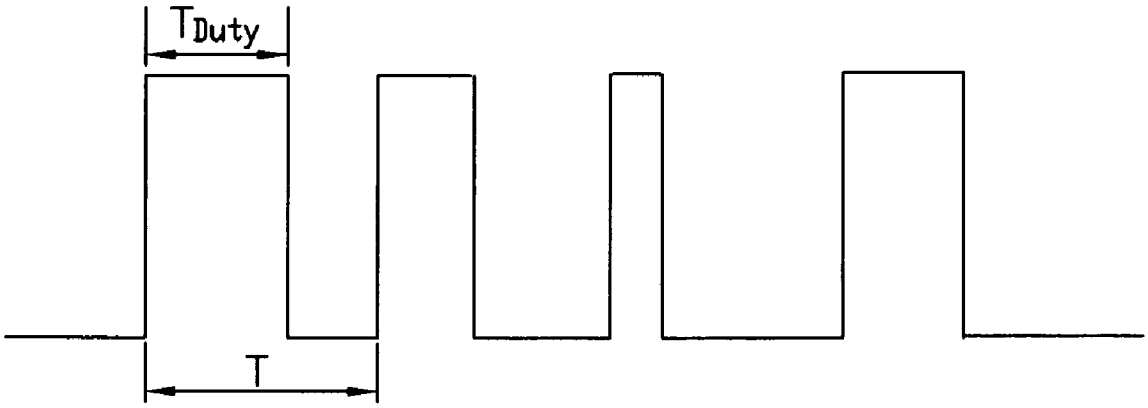
FIG. 4 (RELATED ART)
FIG. 4 depicts one embodiment of a second related art method for modulating illumination of a backlight module of an LCD.

FIG. 2 is a block diagram of a backlight modulation circuit 30 of a second embodiment of the present disclosure. The backlight modulation circuit 30 is similar to the backlight modulation circuit 20 of the first embodiment. However, an illumination modulation signal processing circuit 34 includes a first integrating and smoothing circuit 341, a reversing circuit 342, a PWM filter circuit 343, a second integrating and smoothing circuit 344, a summing circuit 345, an amplifying circuit 346, a selecting circuit 347, and a counting and comparing circuit 348.

The first integrating and smoothing circuit 341 and the PWM filter circuit 343 receive an illumination modulation signal from a scaler (not labeled). The illumination modulation signal is integrated and smoothed into a first direct current voltage by the first integrating and smoothing circuit 341. The first direct current voltage is transmitted to the summing circuit 345. At the same time, the illumination modulation signal is filtered into a PWM signal by the PWM filter circuit 343, and then is integrated into a second direct current voltage by the second integrating and smoothing circuit 344. The second direct current voltage is sent to a second selecting terminal (not labeled) of the selecting circuit 347 to function as a fine modulation signal. Simultaneously, the second direct current voltage is reversed into a negative direct current voltage by the reversing circuit 342. The negative direct current voltage is transmitted to the summing circuit 345. The first direct current voltage and the negative direct current voltage are added by the summing circuit 345, and the summed voltage is amplified by the amplifying circuit 346 to function as a rough modulation signal. The rough modulation signal provided from the amplifying circuit 346 is sent to a first selecting terminal (not labeled) of the selecting circuit 247. The backlight modulation circuit 30 can achieve advantages similar to those of the backlight modulation circuit 20.

It is to be understood, however, that even though numerous characteristics and advantages of certain inventive embodiments have been set out in the foregoing description, together with details of the structures and functions of the embodiments, the disclosure is illustrative only; and that changes may be made in detail, especially in matters of arrangement of parts within the principles of the present invention to the full extent indicated by the broad general meaning of the terms in which the appended claims are expressed.

What is claimed is:

1. A backlight modulation circuit comprising:

a backlight source;

a backlight driving circuit configured for driving the backlight source;

a rough modulation key and a fine modulation key configured for generating a rough triggering signal and a fine triggering signal respectively;

a scaler configured for receiving the rough triggering signal and the fine triggering signal, and generating an illumination modulation signal; and an illumination modulation signal processing circuit configured for receiving the illumination modulation signal and processing the illumination modulation signal to generate one of a rough modulation controlling signal to modulate illumination of the backlight source in a large range and a fine modulation controlling signal to modulate the illumination of the backlight source in a small range;

wherein the illumination modulation signal processing circuit comprises a first integrating and smoothing circuit, a reversing circuit, a pulse width modulation filter circuit, a second integrating and smoothing circuit, a summing circuit, an amplifying circuit, a selecting circuit, and a counting and comparing circuit, the first integrating and smoothing circuit, the reversing circuit, and the summing circuit are electrically connected in series; the pulse width modulation filter circuit, the second integrating and smoothing circuit, and the summing circuit are electrically connected in series; the summing circuit, the amplifying circuit, and the selecting circuit are electrically connected in series; the pulse width modulation filter circuit are electrically connected to the counting and comparing circuit; and the counting and comparing circuit and the second integrating and smoothing circuit are connected to the selecting circuit.

2. The backlight modulation circuit of claim 1, wherein the scaler comprises a rough controlling signal generating circuit, a fine controlling signal generating circuit, and a modulating circuit, the rough controlling signal generating circuit is configured for generating a direct current voltage, the fine controlling signal generating circuit is configured for generating a pulse width modulation signal, and the modulating circuit is configured for modulating the direct current voltage and the pulse width modulation signal into the illumination modulation signal.

3. The backlight modulation circuit of claim 2, wherein the scaler further comprises a rough signal processing circuit and a fine signal processing circuit, the rough signal processing circuit is configured to respond to the rough triggering signal and generate signals to drive the rough controlling signal generating circuit, and the fine signal processing circuit is configured to respond to the fine triggering signal and generate signals to drive the fine controlling signal generating circuit.

4. The backlight modulation circuit of claim 3, wherein the selecting circuit comprises a first selecting terminal and a second selecting terminal, the first selecting terminal is configured for receiving a signal from the amplifying circuit, and the second selecting terminal is configured for receiving a signal from the second integrating and smoothing circuit.

5. The backlight modulation circuit of claim 4, wherein the counting and comparing circuit comprises a counter and comparator, a memory, and a clock signal generator, the memory and the clock signal generator are connected to the counter and comparator, the memory stores a predetermined reference pulse width, the counter and comparator receives a pulse width modulation signal that is separated from the illumination modulation signal through the pulse width modulation filter circuit and is configured for comparing a pulse width of the received pulse width modulation signal with the reference pulse width, and the memory is further configured for storing the pulse width of the received pulse width modulation signal as the reference pulse width for a next comparison.

6. The backlight modulation circuit of claim 5, wherein the clock signal generator is configured for generating clock signals to enable the counter and comparator to calculate the pulse width of the received pulse width modulation signal, and the counter and comparator is further configured for outputting a high level voltage or a low level voltage according to a result of the comparison of the pulse width of the received pulse width modulation signal with the reference pulse width.

7. The backlight modulation circuit of claim 6, wherein when the two compared pulse widths are different, the counter and comparator outputs the high level voltage to the selecting circuit, and the selecting circuit outputs the signal received from the second selecting terminal as the rough illumination modulation controlling signal.

8. The backlight modulation circuit of claim 6, wherein when the two compared pulse widths are the same, the counter and comparator outputs the low level voltage to the selecting circuit, and the selecting circuit outputs the signal received from the first selecting terminal as the fine illumination modulation controlling signal.

9. The backlight modulation circuit of claim 1, wherein the backlight source comprises at least one item selected from the group consisting of light-emitting diodes and cold cathode fluorescent lamps.

* * * * *